US006659555B1

(12) United States Patent
Scholz et al.

(10) Patent No.: US 6,659,555 B1
(45) Date of Patent: Dec. 9, 2003

(54) SPRING UNIT FOR WEIGHT ADJUSTMENT OF A CHAIR

(75) Inventors: Rolf Scholz, Maintal (DE); Frank Weisser, Pegnitz (DE); Armin Sander, Pilsach (DE); Martin Potrykus, Bamberg (DE)

(73) Assignee: Koenig + Neurath AG, Karben (DE)

( * ) Notice: Subject to any disclaimer, the term of this patent is extended or adjusted under 35 U.S.C. 154(b) by 0 days.

(21) Appl. No.: 09/631,920

(22) Filed: Aug. 3, 2000

(30) Foreign Application Priority Data

Feb. 23, 2000 (DE) ..... 100 08 453

(51) Int. Cl.[7] ..... A47C 7/40

(52) U.S. Cl. ..... 297/302.2; 297/300.3; 297/300.5

(58) Field of Search ..... 297/302.2, 302.4, 297/303.2, 303.4, 302.5, 300.3; 248/631, 222.41, 225.11; 247/34, 290, 291, 64.11, 168, 64.12; 188/321.11

(56) References Cited

U.S. PATENT DOCUMENTS 4,200,332 A * 4/1980 Brauning ..... 297/300
4,695,093 A * 9/1987 Suhr et al. ..... 297/300
4,709,962 A 12/1987 Steinmann
4,832,402 A * 5/1989 Zund ..... 297/302
4,838,510 A * 6/1989 Holstensson ..... 248/397
4,858,993 A * 8/1989 Steinmann ..... 297/302
4,962,962 A * 10/1990 Machate et al. ..... 297/300
5,160,184 A * 11/1992 Faiks et al. ..... 297/304

FOREIGN PATENT DOCUMENTS

DE 35 37 203 A1 4/1986
DE 38 34 614 A1 4/1990
DE 298 19 143 U1 3/1999

* cited by examiner

*Primary Examiner*—Peter M. Cuomo
*Assistant Examiner*—Stephanie N Harris
(74) *Attorney, Agent, or Firm*—Laurence A. Greenberg; Werner H. Stemer; Ralph E. Locher

(57) ABSTRACT

A spring unit (11) for the weight setting of a chair (1), in particular an office chair, having a gas spring (12) and having a number of further spring elements (17, 18, 19; 27, 28) which can be connected up to the gas spring (12) individually or in combination. The spring unit (11) is expediently arranged between a seat carrier (7) connected to a rotary column (8) of the chair (1), and the seat (3), or a backrest link (4) which extends at least approximately parallel to said seat (3) and belongs to a backrest (2).

13 Claims, 10 Drawing Sheets

SPRING UNIT FOR WEIGHT ADJUSTMENT OF A CHAIR

BACKGROUND OF THE INVENTION

Field of the Invention

The invention relates to a spring unit for the weight setting of a chair, in particular an office chair, having a first spring element and at least one further spring element. In this case, weight setting is understood to mean the setting of the opposing force to be applied by the spring unit to the weight of the person using the chair.

For the weight setting of a chair, DE 38 34 614 A1 discloses the provision of a spring unit which has a gas spring and a spiral spring which surrounds the latter coaxially and is borne by the gas spring, which is held on the chair frame at one end such that it can rotate. The construction and the mode of action of a gas spring of this type is described, for example, in DE 42 37 495 A1.

In the known spring unit, the prestress of the spiral spring, which acts as a compression spring, is set manually by means of a rotary knob coupled to a sleeve-like driver. The drawback in this case is that, on the one hand, in particular in the case of a permanent maximum weight setting, the spiral spring serving as a compression spring is often kept in the prestressed state to an undesirably high extent and/or over an impermissibly long time period. On the other hand, with a high expenditure of force, which at the same time is undesirable, a large number of revolutions of the rotary knob are needed for the weight setting, so that in the event of a bodily posture which is generally unfavorable, said setting is very time-consuming, because of the often poor accessibility of the rotary knob.

SUMMARY OF THE INVENTION

The invention is therefore based on the object of specifying a spring unit of the type mentioned at the beginning which, while avoiding the aforementioned disadvantages, permits a particularly suitable weight or force setting of a chair over the greatest possible force range. The spring unit is in particular to be suitable for an easy-to-handle weight setting of an office chair provided, for example, with a synchronizing mechanism for adjusting the inclination of a backrest/seat unit.

According to the invention, this object is achieved by the features of claim 1. To this end, provision is made that at a basic setting, preferably for a minimum opposing force to be applied by the spring unit to the weight, only the first spring element is effective. In order to increase the opposing force of the spring unit adjustably, a number of further spring elements can be connected up, individually or in combination in steps, to the first spring element, which is preferably a gas spring. As a result, depending on the set weight—and therefore as a function of the opposing force to be applied by the spring unit to the weight—at least one of the further spring elements is effective in addition to the gas spring. At the same time, both the gas spring and the connected-up spring elements are effective only under load, that is to say when a compressive force or weight is exerted on the spring unit. In other words: when the spring unit is not loaded, in particular none of the connected spring elements is prestressed.

In an advantageous refinement of the spring unit, both the first spring element and the or each further spring element are a gas spring. In this case, the gas springs are jointly held on one side by their housing-side spring ends. Their piston-side spring ends can then expediently be brought into operative engagement, individually or in combination, with an adjusting slotted guide. The gas springs of the spring unit can be arranged beside one another both in a row and in a circle. The adjusting slotted guide can be designed as a perforated slide or as a perforated, rotatable disk. Both the perforated slide and the perforated disk can be provided with a latching mechanism. In this case, the slide or the disk latches in various positions in such a way that the respectively inactivated gas springs slide with their piston-side ends through the holes which are aligned with the latter when no weight is acting on the spring unit.

In an alternative embodiment, the or each further spring element is a spiral spring surrounding the gas spring coaxially. In this case, a first spiral spring surrounding the gas spring and a second spiral spring surrounding the first are expediently provided, between which a distance sleeve can be arranged. The inner, first spiral spring is in this case preferably weaker than the outer, second spiral spring.

In order to connect up the spiral springs to the gas spring, their movable piston end is guided on a cross-shaped arm, on which two plunger arms are arranged such that they can be displaced synchronously and transversely with respect to the spring axis. Depending on the set position of the plunger arms, these either slide past the outer spiral springs—only the gas spring then being effective—or are in an active position with the outer spiral spring, with the inner spiral spring or with both spiral springs.

The advantages achieved with the invention consist in particular in that, as a result of the use of a spring unit expediently having one gas spring as a first spring element for the basic weight setting and having a number of further spring elements which can be connected up individually or in combination to the gas spring, a stepwise setting of the opposing force of the spring unit, and therefore a stepwise weight setting of a chair is possible in a particularly simple way.

The spring unit is particularly suitable for the weight setting of an office chair having a synchronizing mechanism for adjusting the inclination of the backrest or of the latter in a unit with the seat. In this application, the spring unit is expediently arranged between a seat carrier that is connected to a rotary column, and the seat. Alternatively, the spring unit can also be arranged between the seat carrier and a backrest link which extends at least approximately parallel to the seat or to the seating area and belongs to the backrest.

Exemplary embodiments of the invention will be explained in more detail below using a drawing, in which:

DESCRIPTION OF THE PREFERRED EMBODIMENT

Mutually corresponding parts are provided with the same reference symbols in all the figures.

Figure 1:
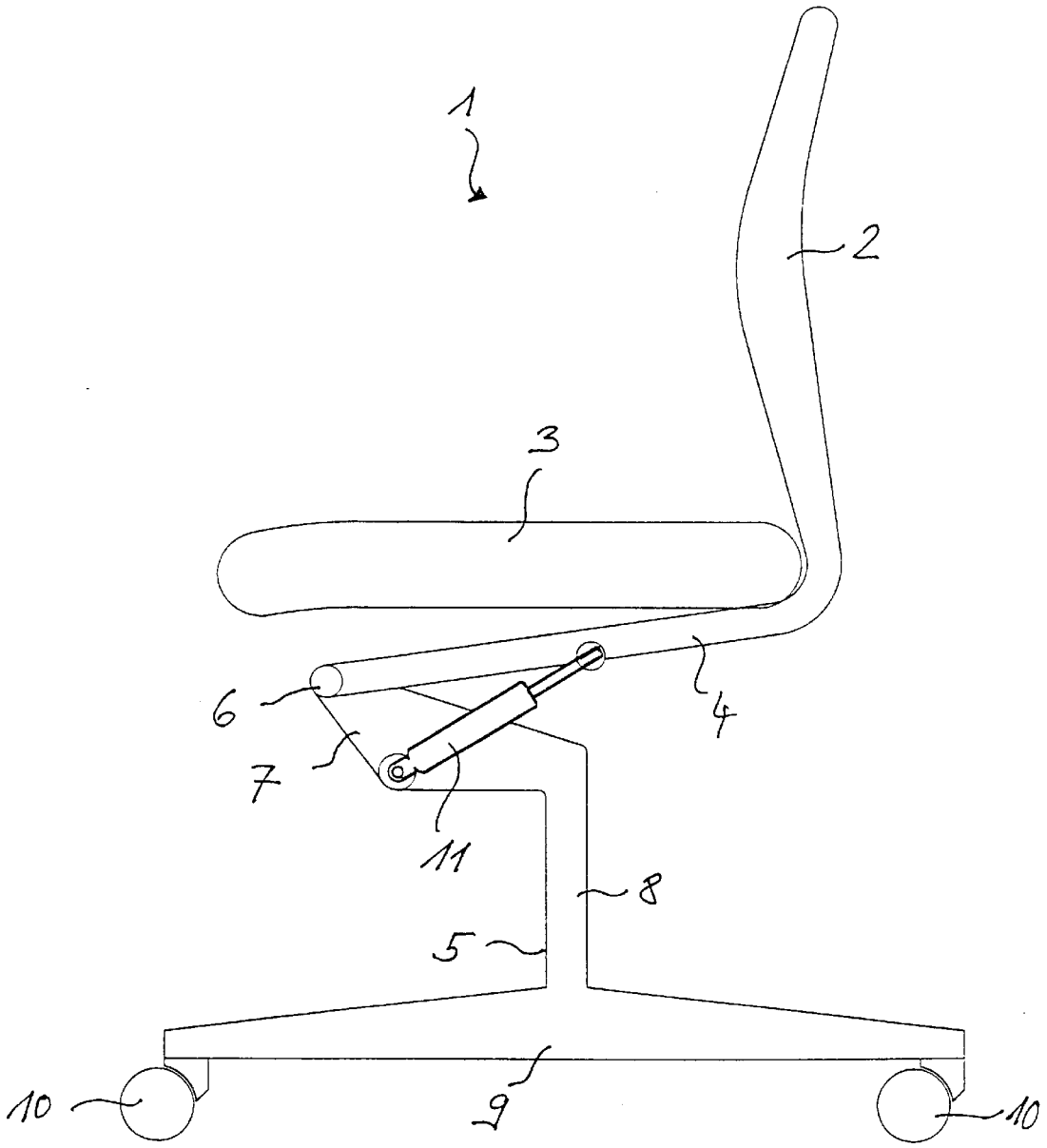
FIG. 1 shows a side view of an office chair with a spring unit according to the invention for the weight setting as part of a synchronizing mechanism of an office chair.

FIG. 1 shows a chair 1 having a so-called synchronizing mechanism for adjusting the inclination of a backrest 2, which is connected to a rotary frame 5 via a backrest link 4 which extends underneath a seating area or a seat 3, at least approximately parallel to the latter. For this purpose, the backrest link 4 has a hinged connection, approximately in the area of the front edge of the seat 3, via a rotary joint 6 to a seat carrier 7 which, for its part, is firmly connected to a rotary column 8 of the rotary frame 5. The rotary frame 5 has a frame foot 9, for example one of star shape, having rollers 10 fastened at the ends. A spring unit 11 provided for the weight setting is held on the housing side on the seat carrier 7 and on the piston side on the backrest link 4, such that it can be rotated or pivoted.

FIGS. 2*a* to 2*d* show a preferred embodiment of the spring unit 11 at various weight or opposing-force settings. The spring unit 11 comprises a gas spring 12, which is fastened to a holding element 13 at its holding or spring end 12*a* on the housing side. Within a pressure housing 14 of the gas spring 12, a piston rod 15 connected at the end to a piston is guided such that it can be moved axially in a manner not specifically illustrated. At its spring end 12*b* on the piston side, the gas spring 12 is guided in an adjusting slotted guide 16 and, by means of the latter, is prestressed in the illustrated position.

Arranged adjacent to this gas spring 12 are three further spring elements 17, 18, 19, again in the form of a gas spring in each case. The further gas springs 17 to 19 are likewise fastened to the holding element 13 by their housing-side spring ends 17*a*, 18*a* and 19*a*. In addition, the further spring elements 17 to 19 are guided on the adjusting slotted guide 16 by their piston-side spring ends 17*b*, 18*b* and 19*b*.

Figure 2A:
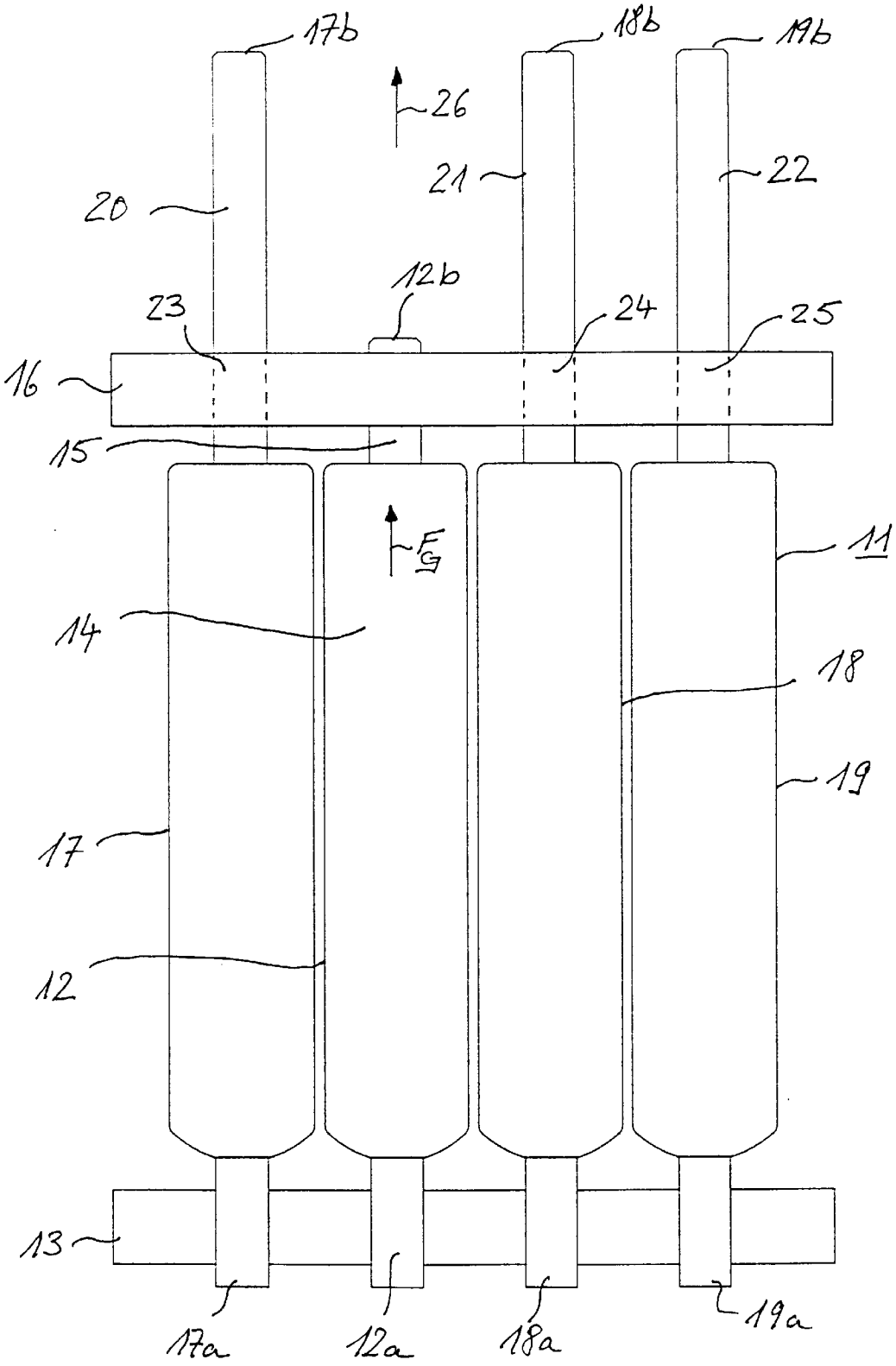
FIGS. 2*a–d* show a first variant of the spring unit with a first gas spring, to which a second, a third and a fourth gas spring are connected up.
Figure 2B:
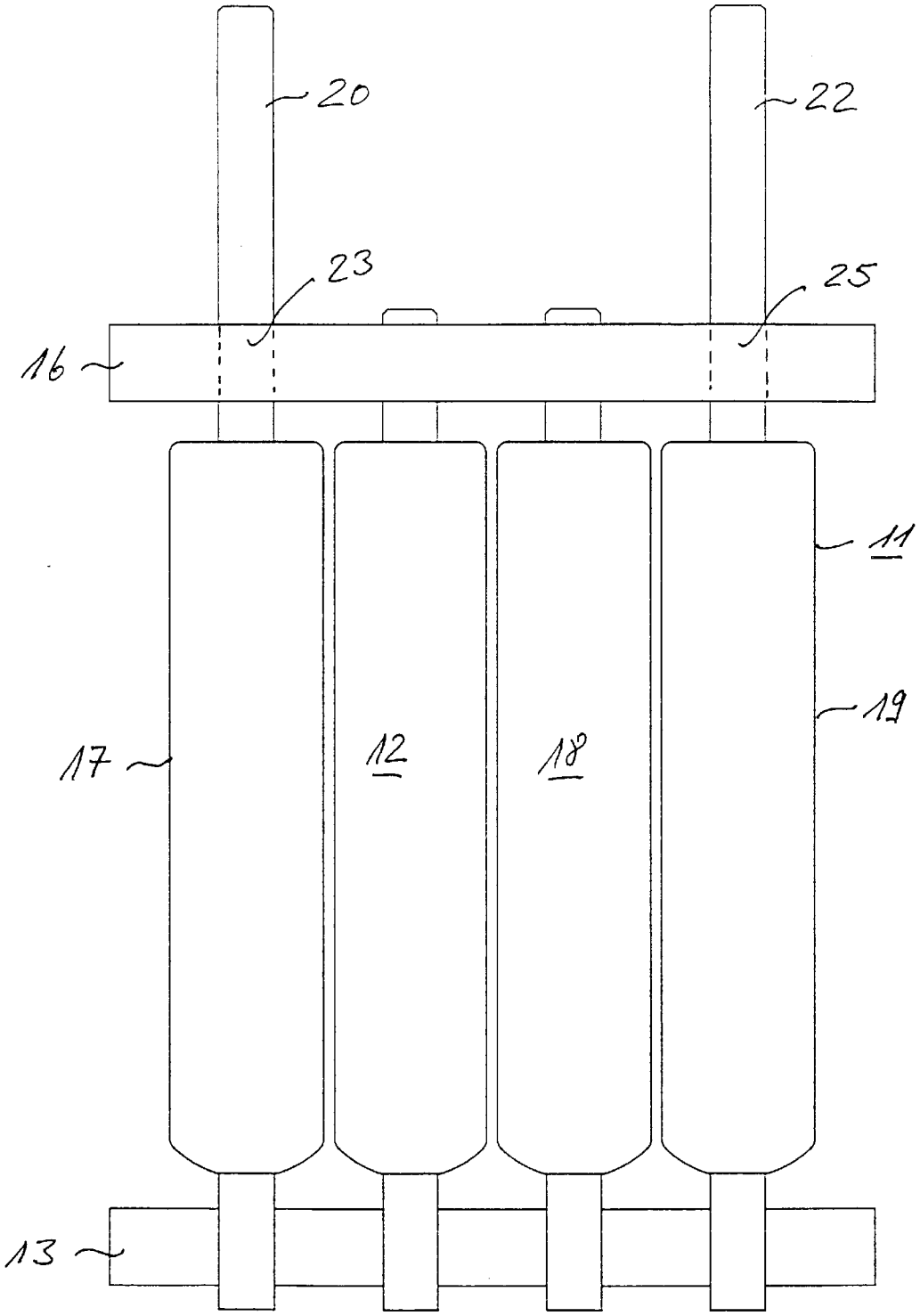
Figure 2C:
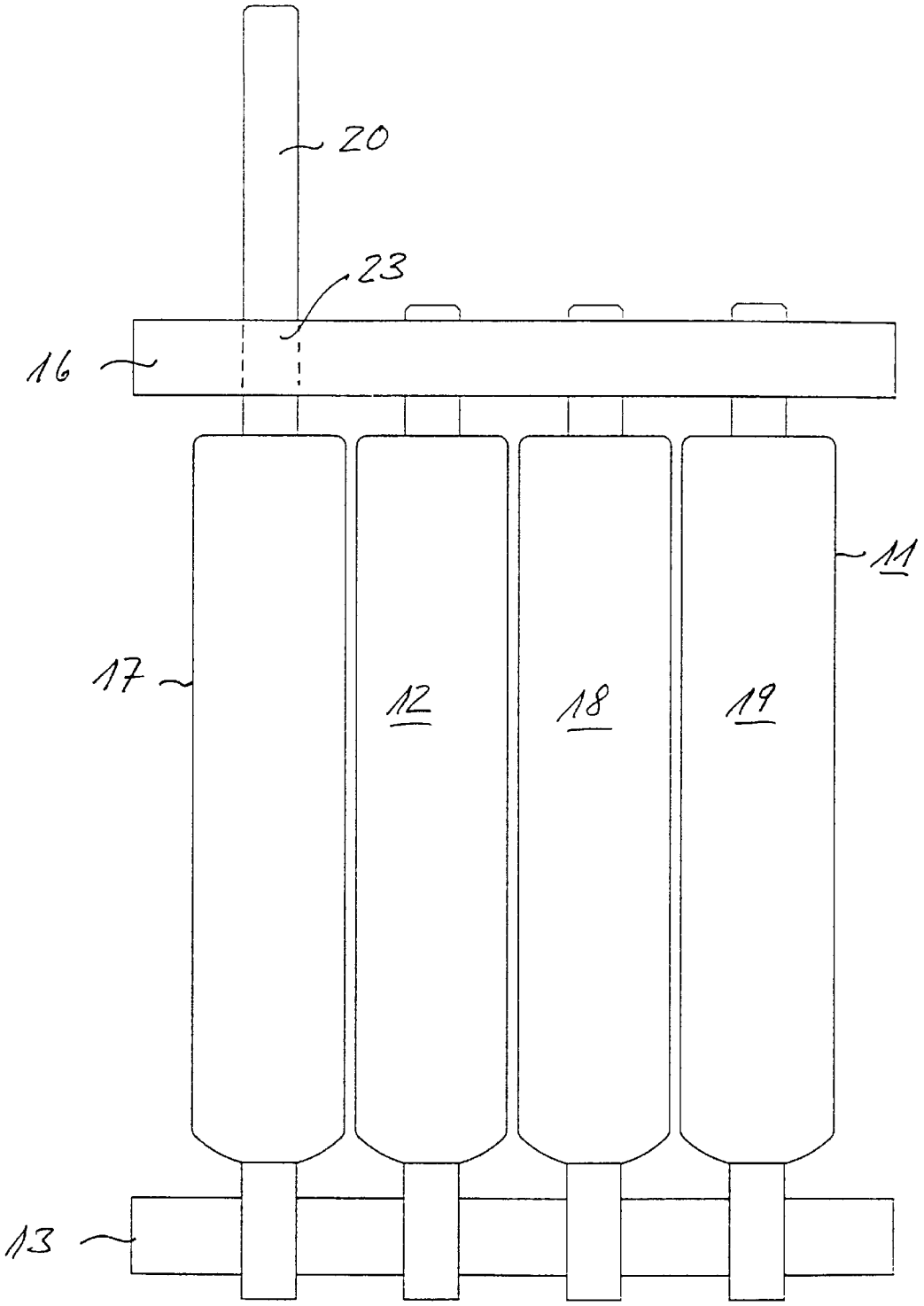
Figure 2D:
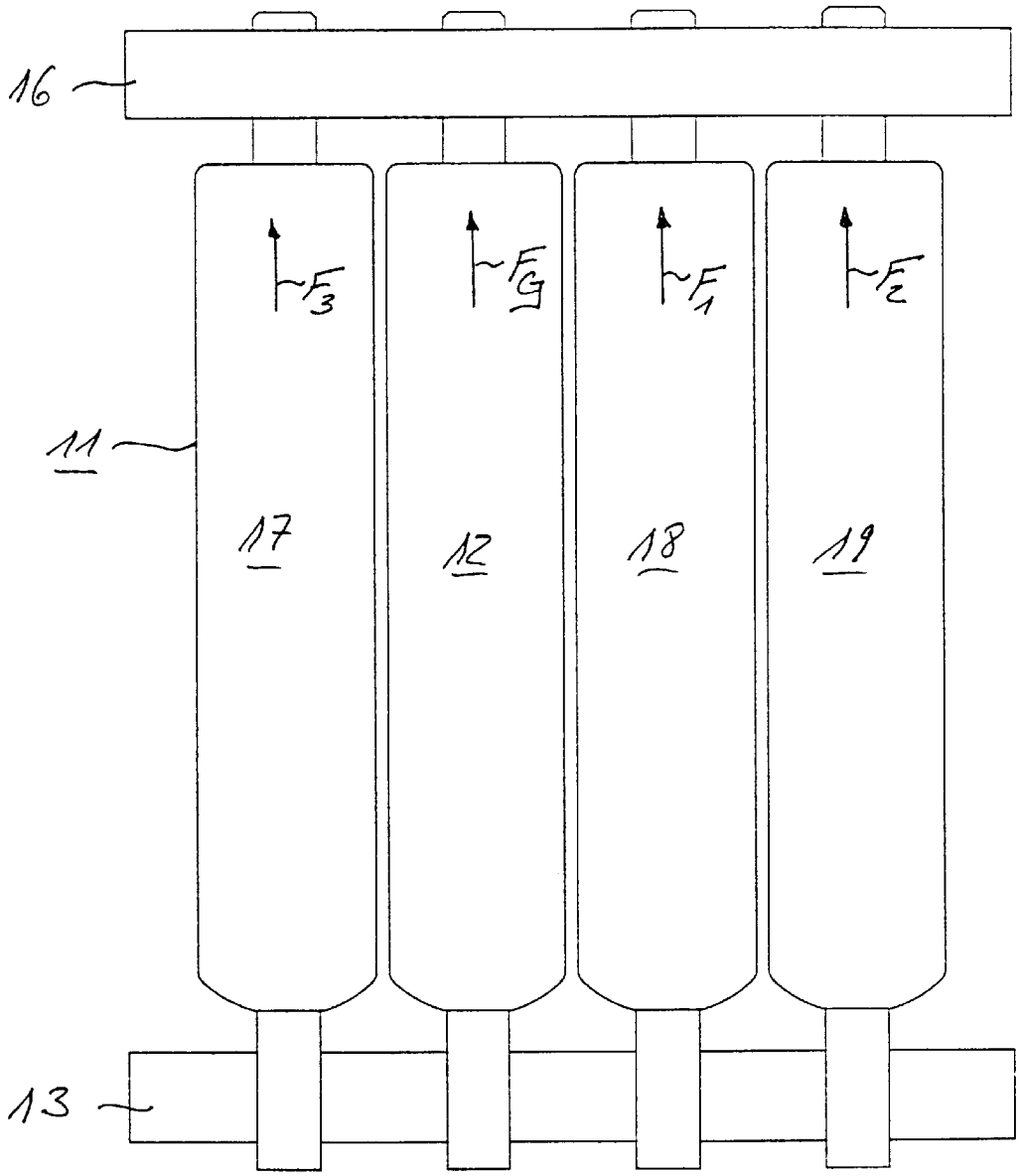

At the basic setting illustrated in FIG. 2*a*, the further spring elements 17 to 19 are not connected up to the gas spring 12, by their piston rods 20, 21, 22 being led through passage holes or openings 23, 24 and 25 provided in the adjusting slotted guide 16. At this basic setting, the further spring elements 17 to 19 are therefore not prestressed. The basic setting corresponds, for example, to a weight of 50 kg of a person occupying the chair 1, so that the opposing force $F_G$ of the spring unit 11, to be applied only by the gas spring 12 and counteracting the weight of the person, is 50 kN in this example.

For the purpose of the weight setting or adjustment, the further spring elements 17 to 19 of the gas spring 12 can be connected up individually or in combination. To this end, the adjusting slotted guide 16 is adjusted manually—in the exemplary embodiment, transversely with respect to the spring longitudinal axis 26—for example is displaced or rotated. Thus, in FIGS. 2*b* to 2*c* of the gas spring 12, the spring element 18, the spring element 19 and, in addition, the spring element 17 are connected up by appropriate adjustment of the adjusting slotted guide 16. The pistons 20, 22 of the spring elements 17 and 19, respectively, are led through the corresponding passage openings 23 and 25 in the adjusting slotted guide without being blocked.

Given a spring or opposing force $F_1$, $F_2$ and $F_3$ (FIG. 2*d*) of the further spring elements 17, 18, 19 of, for example, 10 kN, 20 kN and 40 kN, the opposing force F can be set in steps and therefore in a time-saving manner in 10 kN steps from F=50 kN to F=120 kN. For this purpose, the spring elements 17 to 19 are connected up to the gas spring 12 individually or in an appropriate combination. A continuous and therefore necessarily time-consuming and complicated weight setting is therefore avoided in a simple way.

FIGS. 3*a* to 3*e* show a further embodiment of the spring unit 11, again having a central gas spring 12 for the basic setting of the opposing force $F_G$, and having two further spring elements. These are designed in the form of two spiral springs 27 and 28 surrounding the gas spring 12 coaxially, the inner, first spiral spring 27 being designed to be weaker than the outer, second spiral spring 28. While the inner spiral spring 27 is guided by the pressure housing 14 of the gas spring 12, the outer spiral spring 28 is guided by a positioning and distance sleeve 29 provided between the two spiral springs 27 and 28. In this case, the sleeve 29 at the same time serves as a spacer between the two spiral springs 27 and 28.

In this embodiment of the spring unit 11, the piston rod 15 of the gas spring 12 is guided at the ends on a cross-shaped arm 30, on whose arms 30*a* and 30*b*, extending transversely with respect to the spring longitudinal axis 26, in each case a plunger arm 31*a* and 31*b* of an adjusting plunger 31 is arranged such that it can be displaced. Lever arms 32*a* and 32*b* attached to the plunger arms 31*a* and 31*b* are guided at the ends in a slot 33 which is common to the latter and is provided in the cross-shaped arm 30. Depending on the position of the lever arms 32*a* and 32*b* within the slot 33, the plunger arms 31*a* and 31*b* assume an active position (FIGS. 3*a* and 3*b*) in which they are aligned with the outer spiral spring 28, an active position (FIG. 3*c*) in which they are aligned with the inner spiral spring, an active position (FIG. 3*d*) in which they are aligned with both spiral springs 27 and 28, or an active position (FIG. 3*e*) which projects laterally beyond both spiral springs 27 and 28.

Figure 3A:
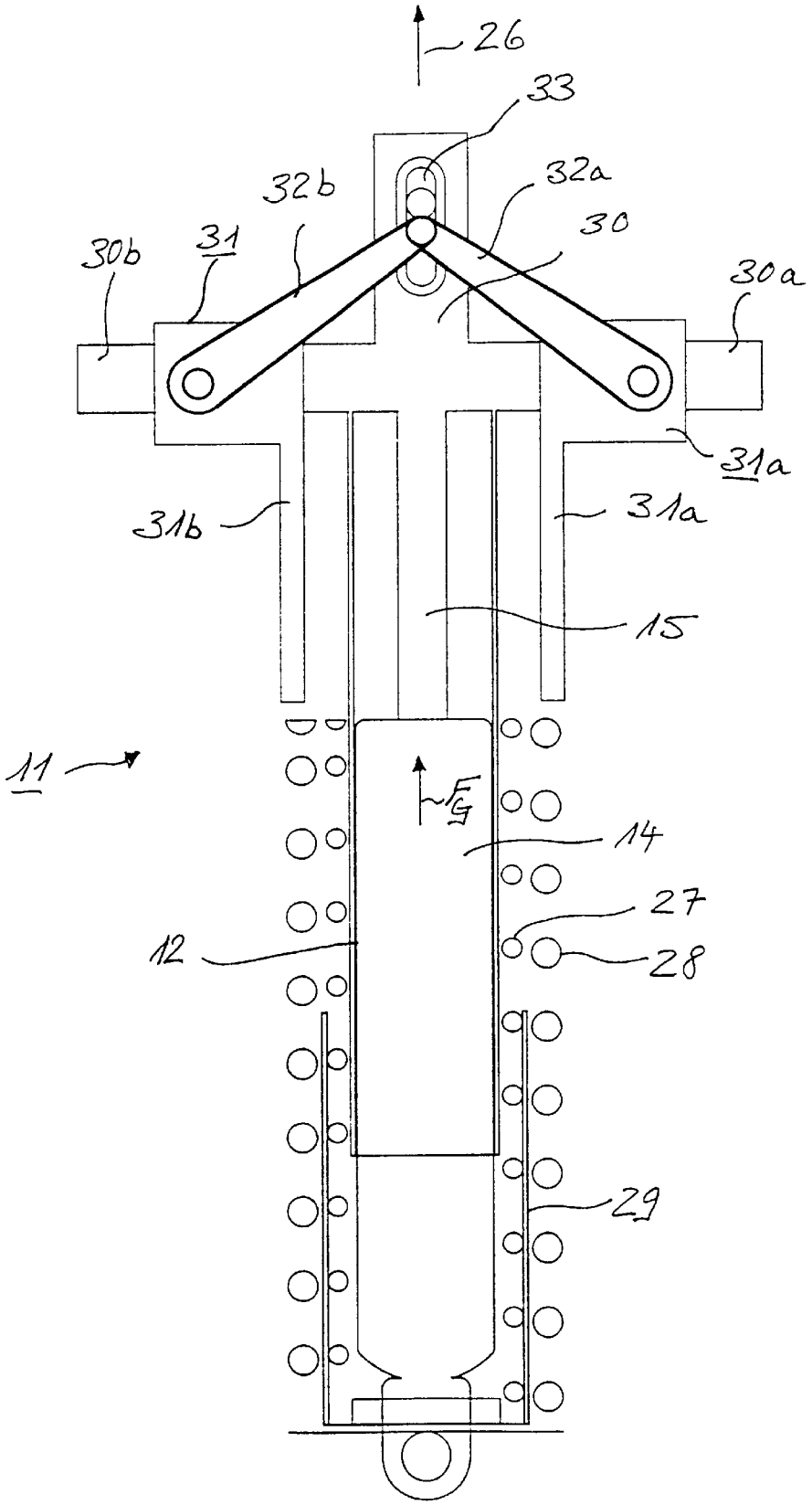
FIGS. 3*a–e* show a second embodiment of the spring unit, having a central gas spring and two spiral springs surrounding the latter coaxially, of which the outer, the inner, both or no spiral spring is connected up.
Figure 3B:
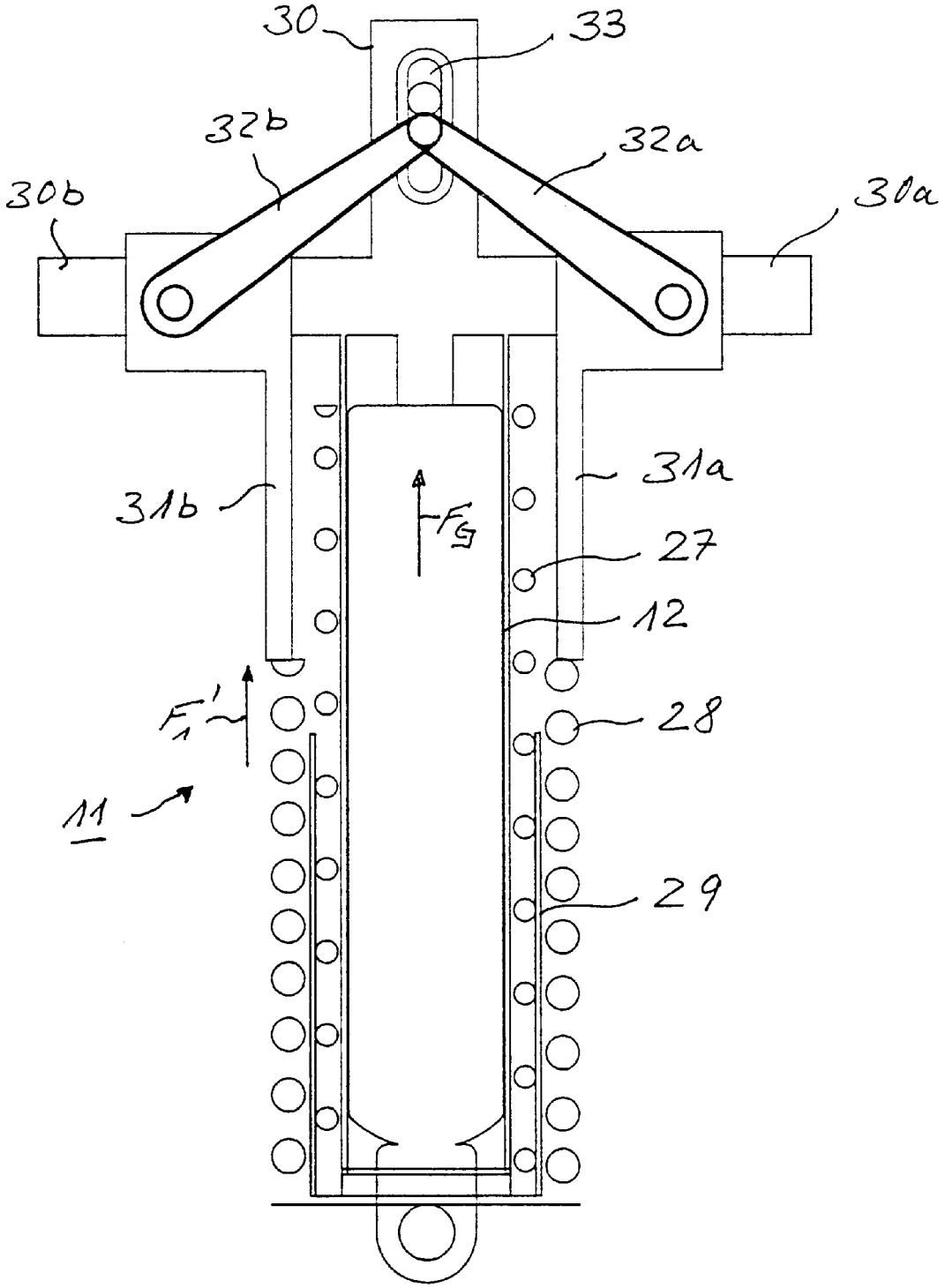
Figure 3C:
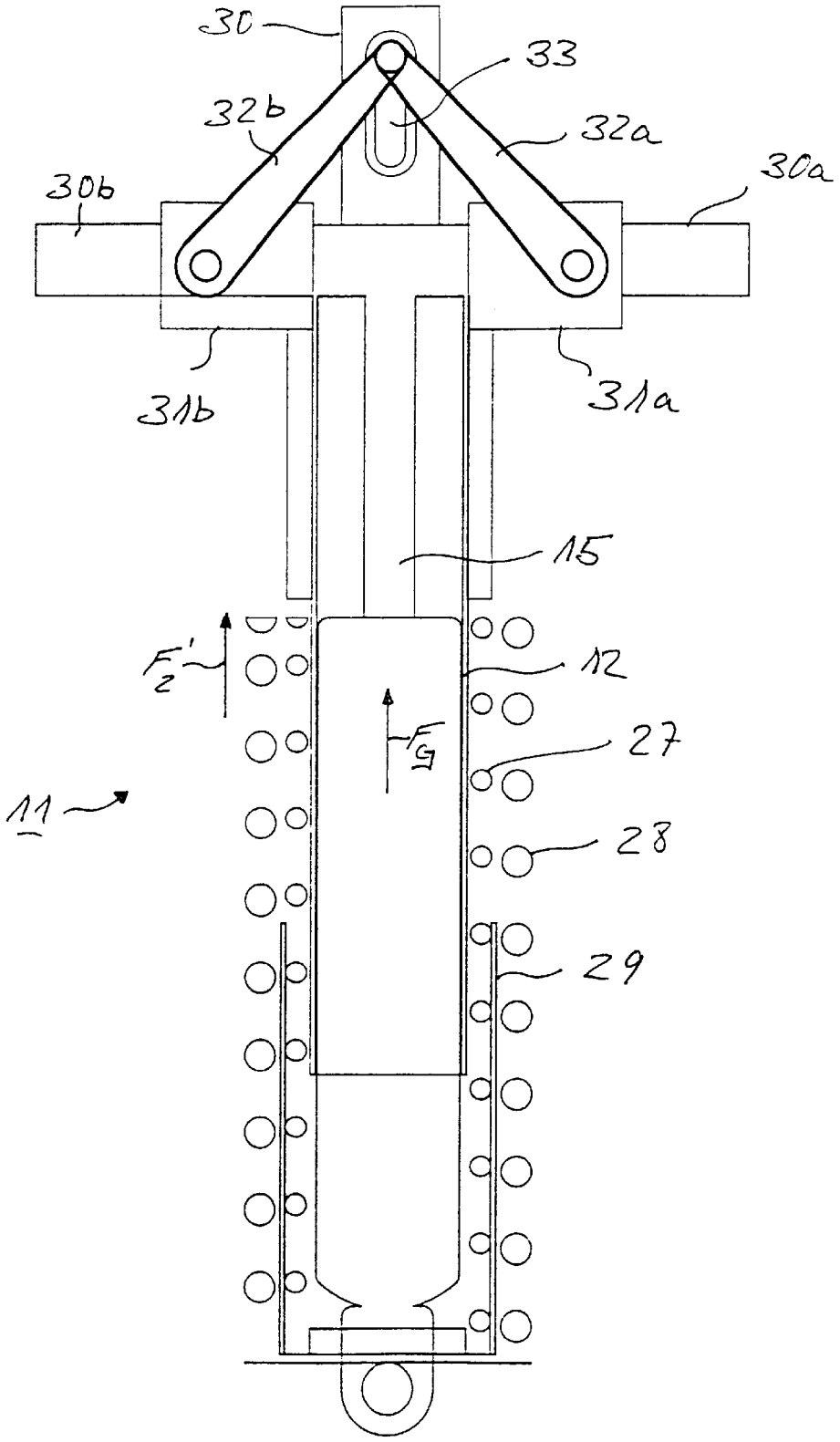
Figure 3D:
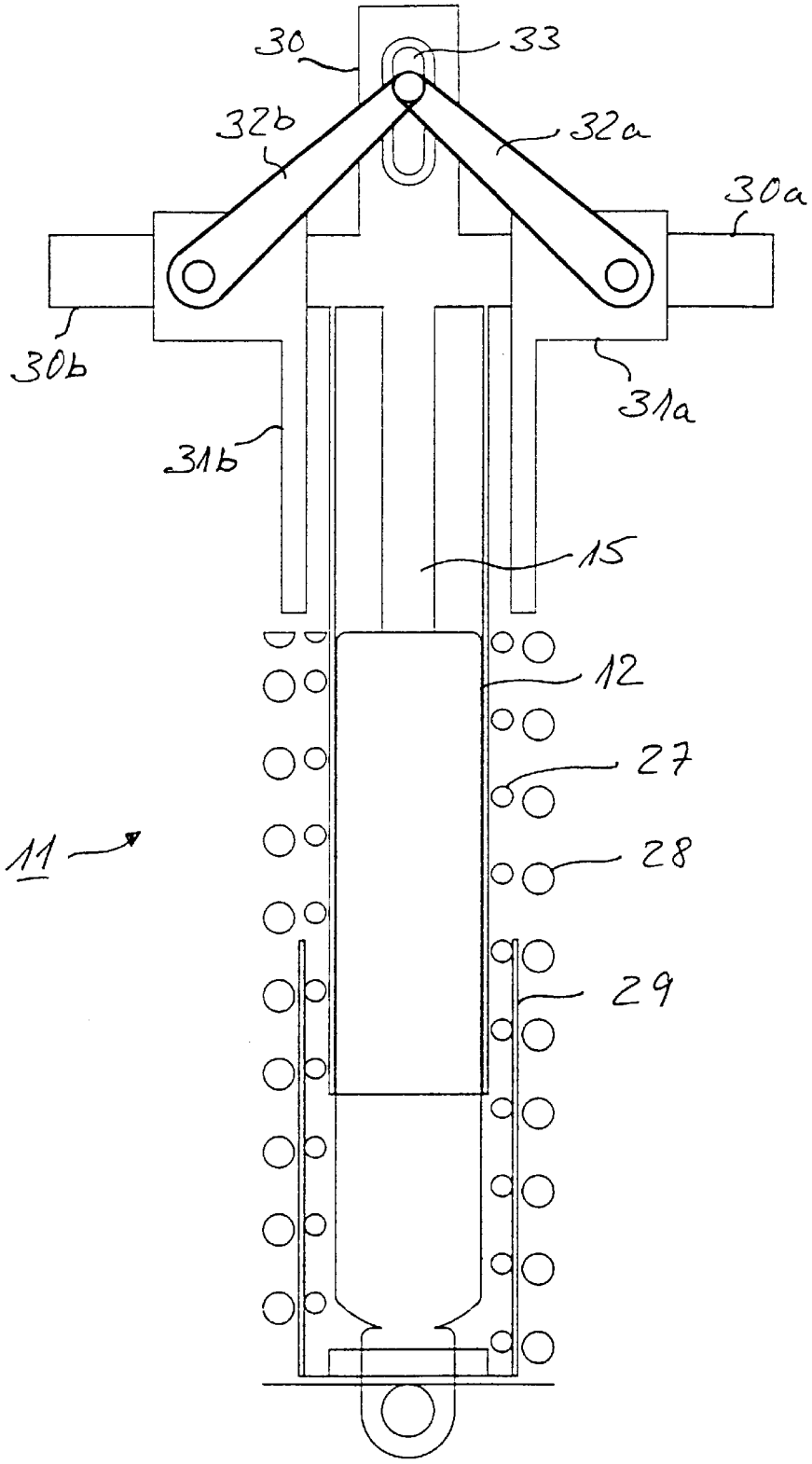
Figure 3E:
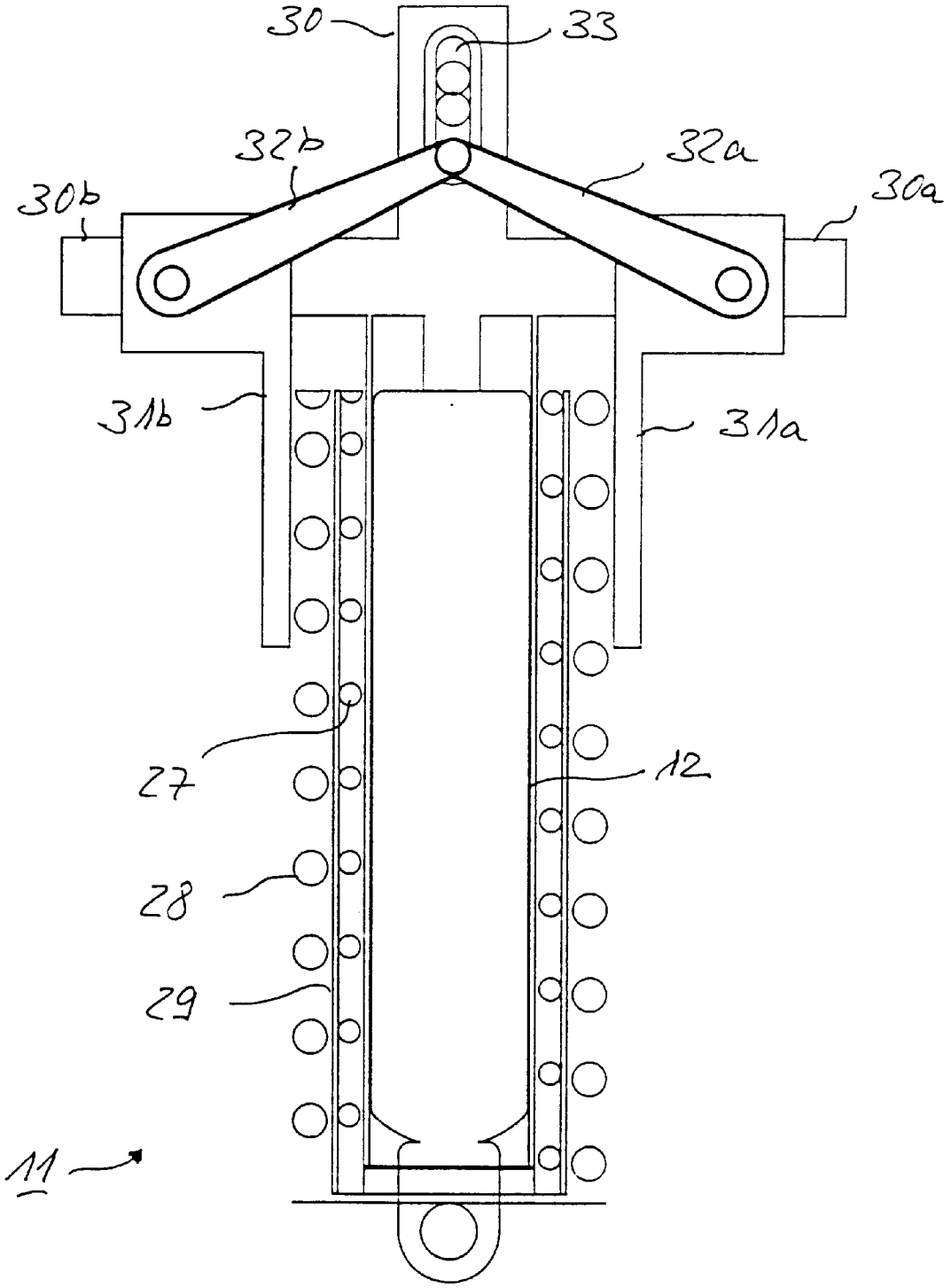

In the last-mentioned active position according to FIG. 3*e*, neither of the two spiral springs 27, 28 is connected up to the gas spring 12. In this active position, the plunger arms 30, 31*a* and 31*b* slide past the outer spiral spring 28 without actively engaging the latter or the inner spiral spring 27, so that the spiral springs 27, 28 are prestressed neither in the loaded nor in the unloaded state of the spring unit 11. This adjustment or slotted-guide setting corresponds to the basic setting of the spring unit 11, with an opposing force $F_G$ of, for example, 50 kN, which corresponds to a weight setting of 50 kg.

In the active position illustrated in FIG. 3*a* of the plunger or adjusting arrangement 30, 31, 32, only the outer spiral spring 28 is connected up to the gas spring 12. However, the outer spiral spring 28 becomes effective only when the spring unit 11 is loaded. In this loading state of the spring unit 11, which can be seen from FIG. 3*b*, the outer spiral spring 28 is used to connect up an additional opposing force $F'_1$ of, for example, 30 kN to the gas spring 12. This would correspond to a weight setting of 80 kg. In the unloaded state (FIG. 3*a*), the outer spiral spring 28 is unstressed, just like the gas spring 12, and is thus inactive.

In the active position illustrated in FIG. 3*c* of the adjusting or plunger arrangement 30, 31, 32, only the inner, comparatively weak spiral spring 27 is connected up to the gas spring 12, analogously to FIG. 3*a*. In the loaded state of the spring unit 11, the inner spiral spring 27 is used to connect up an additional opposing force $F'_2$ or, for example, 20 kN to the gas spring 12, which would correspond to a weight setting of 70 kg. Here, too, the inner spiral spring 27 is not prestressed in the illustrated, unloaded state of the spring unit 11. By contrast, in the active position illustrated in FIG. 3*d* of the plunger or adjusting arrangement 30, 31, 32, both the outer spiral spring 28 and the inner spiral spring 27 are connected up to the gas spring 12. This corresponds to a weight setting of 100 kg.

What is claimed is:

1. A spring unit for the weight-setting of a chair, comprising:

a first gas spring element for the weight-setting of a chair;

further spring elements; and an adjusting device for selectively engaging a given combination of said further spring elements to act in parallel with said first gas spring element to adjust the weight setting of the chair.

2. The spring unit according to claim 1, wherein said further spring element is one of at least two further spring elements each disposed to be connected up to said first spring element, selectively individually and in combination.

3. The spring unit according to claim 1, wherein said further spring element is a gas spring.

4. The spring unit according to claim 1, wherein said first spring element and said further spring element are gas springs.

5. The spring unit according to claim 4, which comprises a common holding element retaining said gas springs at respective housing-side spring ends thereof, and a slotted adjusting guide at which respective piston-side spring ends of said gas pistons can be brought into individual operative engagement.

6. The spring unit according to claim 1, wherein said further spring element is a helical spring coaxially surrounding said gas spring.

7. The spring unit according to claim 1, wherein said further spring element comprises a first helical spring surrounding said gas spring and a second helical spring surrounding said first helical spring, wherein said first helical spring is weaker than said second helical spring.

8. The spring unit according to claim 7, which comprises a sleeve member disposed between said first helical spring and said second helical spring.

9. The spring unit according to claim 7, which comprises a cross-shaped arm on a piston side of said spring, whereby said gas spring is guided on said cross-shaped arm, two plunger arms guided on said cross-shaped arm to be synchronously displaced transversely to a longitudinal axis of said spring, whereby said plunger arms, upon being transversely displaced, are brought into a functionally active position with said first and second helical springs.

10. The spring unit according to claim 6, which comprises a cross-shaped arm on a piston side of said spring, whereby said gas spring is guided on said cross-shaped arm, two plunger arms guided on said cross-shaped arm to be synchronously displaced transversely to a longitudinal axis of said spring, whereby said plunger arms, upon being transversely displaced, are brought into a functionally active position with said helical spring.

11. In combination with a chair, the spring unit according to claim 1.

12. The combination according to claim 11, wherein the spring unit is disposed between a seat carrier connected to a rotary column, and a seat of the chair.

13. The combination according to claim 11, wherein the spring unit is disposed between a seat carrier connected to a rotary column, and a backrest link extending substantially parallel to a seat and supporting a backrest of the chair.

* * * * *